United States Patent [19]

Peterson

[11] Patent Number: 4,930,047

[45] Date of Patent: May 29, 1990

[54] APPARATUS FOR INTERCONNECTING COMPONENTS OF A POWER OUTLET STRIP

[75] Inventor: Gerald E. Peterson, Riverside, Calif.

[73] Assignee: The Toro Company, Minneapolis, Minn.

[21] Appl. No.: 242,579

[22] Filed: Sep. 12, 1988

[51] Int. Cl.[5] ..... H01H 83/02

[52] U.S. Cl. ..... 361/395; 200/51 R; 335/18; 361/118; 361/356; 361/407; 439/535

[58] Field of Search ..... 335/18; 200/51 R, 61.58 R; 174/53, 58, 59; 307/115, 147, 150; 361/118, 331, 334, 356–361, 380, 392, 395, 399, 407, 412, 413; 439/55, 76, 131, 535, 686, 724, 725

[56] References Cited

U.S. PATENT DOCUMENTS

| | | | |
|---|---|---|---|
| 728,195 | 5/1903 | Brady | 361/340 |
| 2,734,151 | 2/1956 | Jacobs . | |
| 3,475,657 | 10/1969 | Knowles . | |
| 3,827,005 | 7/1974 | Friend . | |
| 3,924,918 | 12/1975 | Friend . | |
| 4,201,432 | 5/1980 | Chalmers . | |
| 4,230,383 | 10/1980 | Burnstein et al. . | |
| 4,232,923 | 11/1980 | Otsuki et al. . | |
| 4,236,128 | 11/1980 | Cooper | 361/356 |
| 4,642,733 | 2/1987 | Schacht | 361/118 |
| 4,688,135 | 8/1987 | Leopold | 361/395 |
| 4,729,059 | 3/1988 | Wang | 361/356 |

*Primary Examiner*—Gerald P. Tolin
*Attorney, Agent, or Firm*—R. Lawrence Buckley

[57] ABSTRACT

A power outlet device (10) including a plastic case (12); ground, neutral and hot conductive strips (30, 28, 26); and a printed circuit board assembly (54) connected to strips (30, 28, 26). The printed circuit board assembly (54), which could include a surge suppressing circuit, is connected to the strips (26, 28, 30) through the use of resilient contacts (58, 60, 56, respectively). Blades (58, 60, 56) extend upward and laterally from the substrate (55) of printed circuit board assembly (54). A bottom cover (14) of case (12) presses against the underside of substrate (55) to urge contacts (56, 58, 60) into resilient conductive contact with the strips (30, 26, 28, respectively). A preferred power outlet device (10) also includes a pair of one-piece sheet metal jumpers (50, 120) which interconnect various components thereof.

6 Claims, 3 Drawing Sheets

APPARATUS FOR INTERCONNECTING COMPONENTS OF A POWER OUTLET STRIP

TECHNICAL FIELD

The invention relates generally to packaging and assembly of electrical components, and more particularly to power outlet devices, e.g., power strips.

BACKGROUND OF THE INVENTION

Power outlet devices, occasionally called multi-outlet centers, are well known. A typical power outlet device is a power outlet strip ("POS") having a single male plug which can be inserted into a standard 110 VAC receptacle; a body forming a pluralitY (perhaps six or so) of female receptacles; and an on/off switch. Thus, a POS in effect "expands" a single 110 VAC receptacle into several receptacles. POS devices have recently become very popular for supplying power to microcomputer systems including, for example, a microcomputer, a printer, a modem, and perhaps other peripheral devices, the idea being that the entire system can be protected and energized/de-energized through the use of a single protective device having a single on/off switch.

Common POS features include high current protection; high voltage protection; and noise filtering. In prior POS's the components (e.g. circuit breakers, metal oxide varistors (MOV's), caPacitors) responsible for such features were typically soldered or crimped together in rather crude fashion, and the resulting agglomeration of components was attached to three metallic power strips or busses (hot, neutral, and ground) using wires and slip-on connectors. Thus, the individual components were manually interconnected and the subassembly was then manually connected to the bus strips of the POS using wires terminated with female slip-on connectors. This labor-intensive assembly procedure was very slow and therefore added significant cost to the product. Moreover, the integrity of the connections between components and to the bus strips was not consistent. Finally, the prior art assembly technique did not lend itself well to quality inspections and replacements during fabrication. For example, it was difficult to test the subassembly of current/voltage protection/filtering components and replace it if necessary.

The POS of the present invention addresses the problems associated with prior art POS's. In particular, Applicant's POS assembles very easily and quickly compared to prior art POS's, and facilitates testing of electrical components and the replacement of defective components or subassemblies.

SUMMARY OF THE INVENTION

One aspect of the invention is directed toward a power outlet device including a strip assembly; a printed circuit board assembly including a power conditioning circuit; a case for receiving the strip and printed circuit board assemblies; and conductive resilient contact means connected to and extending from the printed circuit board assembly for operatively connecting the printed circuit board assembly to the strip assembly, wherein the assemblies are conductively interconnected simply by positioninq the printed circuit board assembly relative to the strip assembly such that the contact means springingly engages the strip assembly.

Another aspect of the invention is directed toward "jumpers" which can be used to interconnect various components of a power outlet device. One jumper is a circuit breaker-to-switch jumper which spans between a switch terminal and a circuit breaker terminal; another is a circuit breaker-to-strip jumper for interconnecting the circuit breaker and hot strip (of the strip assembly referred to above). Each jumper includes a substantially planar horizontal portion and a pair of vertical slip-on lugs.

BRIEF DESCRIPTION OF THE DRAWING

A preferred embodiment of the invention will be described with reference to the appended Drawing wherein.

DETAILED DESCRIPTION OF PREFERRED EMBODIMENT

Figure 1:
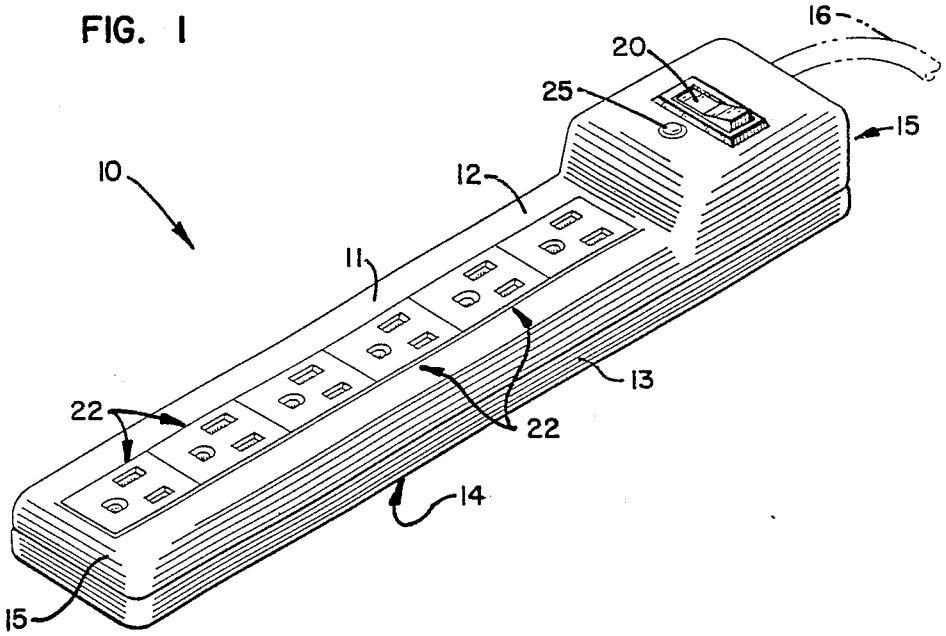
FIG. 1 is a perspective view of a POS according to the invention.

Referring to the Drawing, wherein like reference numerals designate like parts and assemblies throughout the several views. FIG. 1 shows a perspective view of a power outlet strip ("POS") 10 according to the invention. POS 10 is preferably packaged within a plastic case 12 having a bottom cover 14 sonically welded or otherwise secured thereto. Case 12 possesses a top surface 11, side panels 13 and end panels 15. Extending from one of the end panels 15 of case 12 is a three-conductor cord 16 terminated with a standard male plug (not shown) suitable for connection to a 110 VAC receptacle. Located on the top surface 11 of case 12 is an on/off rocker switch 20 which selectively activates/-deactivates a plurality of female recePtacles 22 formed in the top surface 11 of case 12. Optionally, POS 10 includes a circuit breaker 24 and an indicator light 25 (light emitting diode, preferably). the latter indicating when the high voltage protection circuit (described generally below) is intact and operational.

Figure 2:
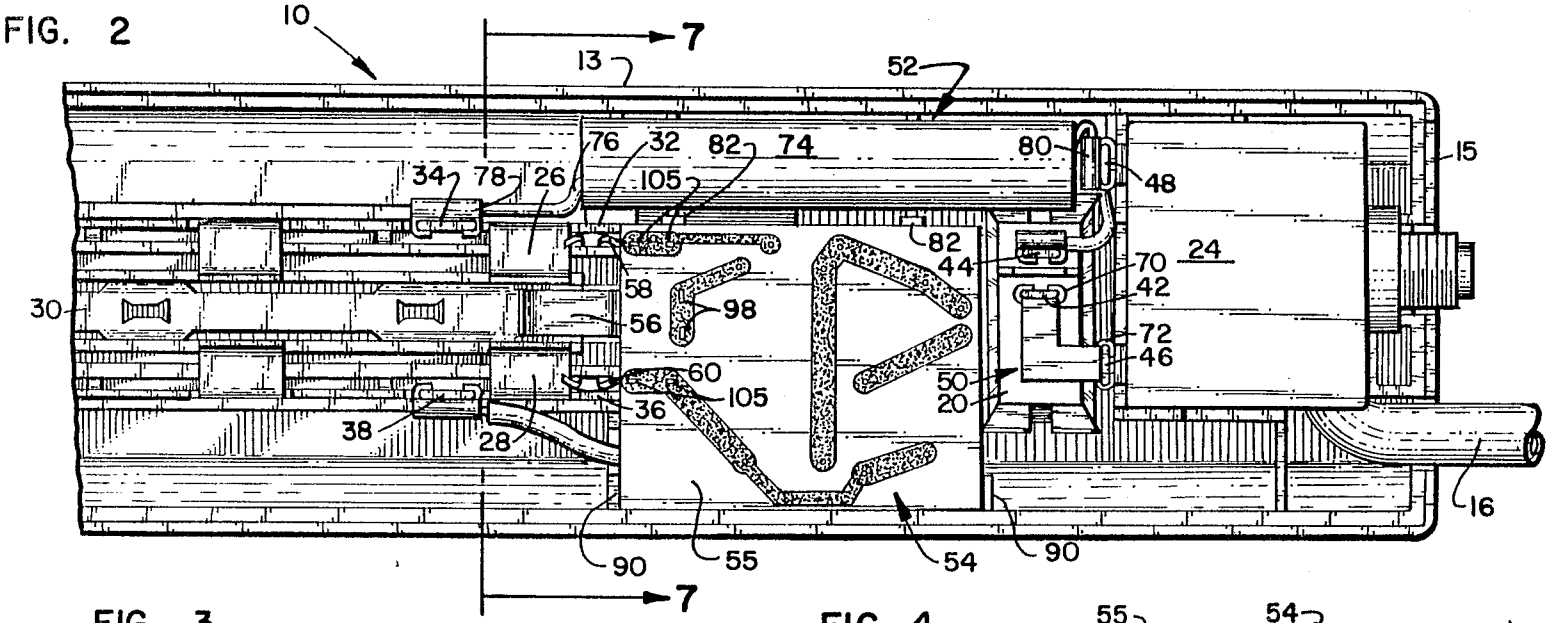
FIG. 2 is a partial bottom plan view of the POS of FIG. 1 with the bottom panel removed.

With reference to FIG. 2, a bottom plan view of POS 10 with bottom cover 14 removed, case 12 houses the various electrical components which combine to provide "conditioned" 110 VAC power to female receptacles 22. Power is distributed to parallel receptacles 22 through three stamped elongate metal strips i.e. a hot strip 26 a neutral strip 28 and a ground strip 30, substantially running the length of POS 10. Each strip 26, 28, 30 is preferably made of 0.015 inch thick brass which is cut and formed using standard sheet metal forming techniques. Strips 26, 28, 30 are formed such that they are firmly held in place within recesses formed in plastic case 12, and plugs inserted through top panel 11 and into receptacles 22 make contact with strips 26, 28 and 30. For purposes which will be described in greater detail below, hot strip 26 forms first and second tabs 32 and 34 which extend vertically downward from the top surface 11 of case 12. Neutral strip 28, which is a mirror image of hot strip 26, also forms first and second tabs 36 and 38; and ground strip 30 forms a single tab 40 which extends substantiallY parallel to the top surface 11 of case 12. Tabs 34, 38, 40 are preferably rectangular in shape and configured to receive slip-on connectors or lugs.

With further reference to FIG. 2, on/off switch 20 includes first and second rectangular stamped metal terminals 42 and 44 which extend vertically downward from switch 20 (aWay from top panel 11). Similarly, circuit breaker 24 includes first and second vertically-oriented terminals 46 and 48, and circuit breaker first terminal 46 is preferably connected to on/off switch first terminal 42 through the use of a formed metal circuit breaker-to-switch jumper 50 which is described in some detail below. The remaining electrical components of POS 10 are an inductor coil 52 and a printed circuit board assembly ("PCB") 54. Inductor coil 52 preferably connects between second terminal 48 of circuit breaker 24 and hot strip second tab 34. And, as further discussed below, PCB 54 conductively connects to bus strips 26, 28, 30, respectively, through the use of a hot contact blade a neutral contact blade 60: and a ground contact spring 56. Neutral contact blade 60 extends from PCB 54 and engages an inner vertical surface of neutral strip first tab 36. Likewise hot contact blade 58 conductively engages an inner vertical surface of hot strip first tab 32. And, in similar manner, ground contact spring 56 springingly and conductively engages a substantially horizontal ground strip contact area on the underside of ground strip 30.

Circuit breaker-to-switch jumper 50 is preferably made of 0.20 inch thick sheet brass which is formed using standard sheet metal forming techniques. Jumper 50 includes a flat L-shaped portion 68, a switch lug 70 and a circuit breaker lug 72, wherein lugs 70 and 72 are mutually perpendicular and extend perpendicularly from L-shaped portion 68. That is, each arm of L-shaped portion 68 terminates in a lug, and the lugs are therefore perpendicular to one another and to the plane which contains L-shaped portion 68. Lugs 70 and 72 are in the nature of slip-on connectors, and as such frictionally engage first terminal 42 of switch 20 and first terminal 46 of circuit breaker 24, respectively. That is, each lug 70, 72 includes a pair of curved end pieces spanned by a planar web, wherein when the lugs 70 and 72 are slipped over the corresponding terminals 42 and 46 the web of each lug is immediately adjacent and Parallel to the corresponding terminal and the end pieces of the lug in effect frictionally grip the edges of the terminal. Thus, to make the connection between circuit breaker 24 and switch 20, one merely (i) positions jumper 5 such that L-shaped portion 68 is parallel to top panel 11 and lugs 70 and 72 aligning respectively, with terminals 42 and 46; and (ii) pushes jumper B downward to force lugs 70 and 72 over terminals 42 and 46, respectively. By contrast, prior art designs used wires terminated with slip-on connectors to connect between such components, and therefore two distinct motions were required to make the connection between components adding time and cost to the assembly process. Moreover, the integrity of the wire/lug path was always at issue, due to potential wire breakage or loose wire-to-lug connections.

Figure 5:
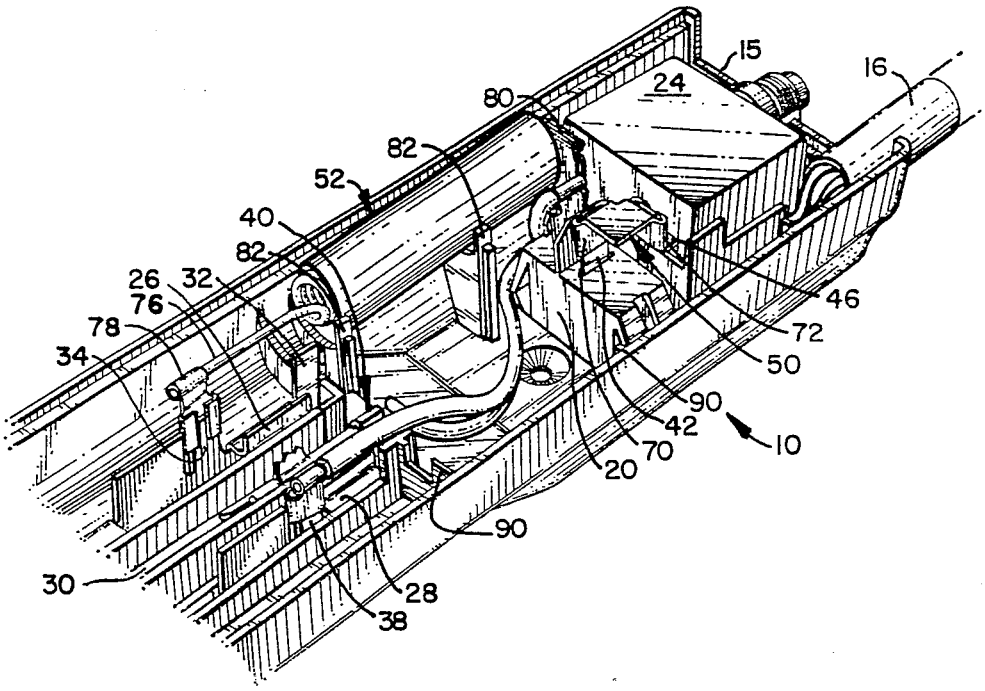
FIG. 5 is a perspective view of a portion of the POS of FIG. 1, minus the PCB, showing the circuit breaker-to-switch jumper and the coil.
Figure 6:
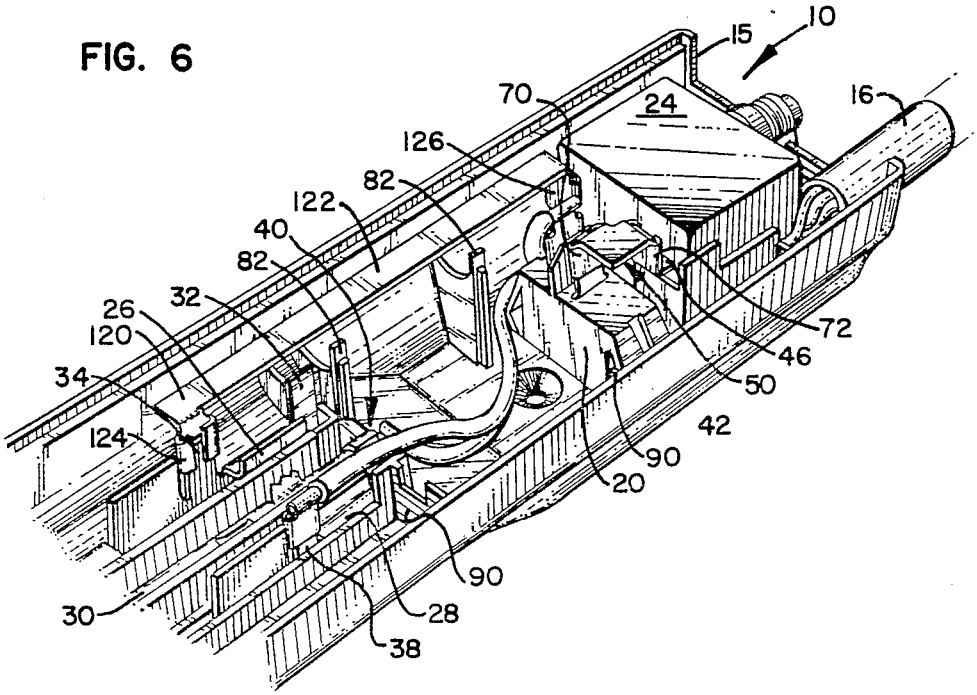
FIG. 6 is a perspective view of a portion of the POS of FIG. 1, minus the PCB, showing the optional circuit breaker-to-strip jumper.

Referring Primarily to FIGS. 5 and 6 coil 52 includes a substantially cylindrical portion 74 located proximate circuit breaker 24. Coil 52 is formed from a single wire spirally wound about an iron core, and extending horizontally from one end of cylindrical portion 74 is one end 76 of the wire which terminates with a vertically-oriented power strip lug 78, wherein the latter conductively engages tab 34 of power strip 26. The opposite end of the wire which forms coil 52 terminates in a circuit breaker lug 80 which connects to terminal 48 of circuit breaker 24. It should be noted that terminal 48 and tab 34 are perpendicular, thus necessitating the proper forming of coil 52 and orientation of lugs 78 and 80.

As noted above, case 12 houses all of the electrical components which are included in preferred POS 10. Integral with case 12 are standoffs 82 (see FIGS. 5 and 6) which vertically engage and support substrate 55 of PCB 54 on its top surface. Substrate 55 is restrained laterally by one side 13 of case 12 and standoffs 82; and longitudinally by fore-and-aft restraints 90. PCB 4 is held in place vertically primarily by virtue of the frictional interaction between controls 5B and 60 and tabs 32 and 36, respectively, although to some degree standoffs 82 and restraints 90 grip the periphery of substrate 55 and prevent PCB B4 from falling out of position. When bottom cover 14 is secured to case 12, PCB 54 cannot move in any direction and thus the connections between PCB 54 and strips 26, 28 and 30 are ensured.

Figure 4:
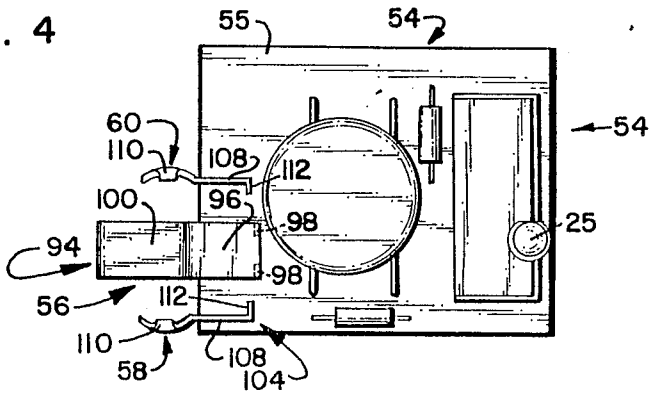
FIG. 4 is a plan view of the PCB of FIG. 3.
Figure 3:
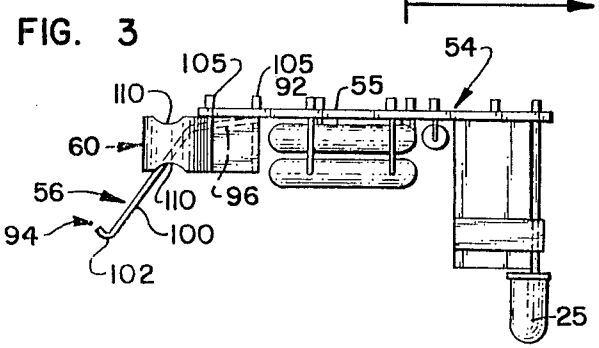
FIG. 3 is a side view of the printed circuit board assembly ("PCB") of the POS shown in FIG. 1, showing the PCB contacts.

Referring in particular to FIGS. 3 and 4, which show enlarged views of PCB 54, ground contact spring 56 includes a fixed end 92 and a free end 94. Fixed end 92 includes a substantially square, substantially horizontal, portion 96 which extends upward from the top surface of substrate 55 at a shallow angle, perhaps five or ten degrees. Portion 96, where it engages substrate 55, forms a pair of small vertical fingers 98 which are received by a pair of small apertures in substrate 55. Fingers 98 are soldered into the circuit carried by PCB 54. On the opposite end from fingers 98, angling upward from portion 96 and forming an obtuse angle with portion 96 of about 135°, is an angled portion 100 which is roughly twice as long as portion 96 and terminates at free end 94 with a curved portion 102 suitable for conductive contact with ground strip 30. Thus, spring 56 has a "dogleg" configuration. Due to the angle between position and substrate 55, and the diminutiveness of fingers 98 spring 56 actually has a fairly small spring constant initially, but a relatively large spring constant once portion 96 is forced downward into contact with substrate 55. Due to the deformation of spring 56 and the fact that spring 56 is not stressed beyond its elastic limit, a continuous force is applied between spring 56 and ground strip 30 so as to maintain conductive contact therebetween. The preferred material for ground contact spring 56, as well as contact blades 58 and 60, is 0.015 brass.

Contact blades 58 and 60 are preferably mirror images of one another. Each includes a fixed end 104 and a free end 106. A pair of fingers 105 extends vertically downward from each fixed end 104. Fingers 105 are received by holes in substrate 55 and soldered in place, to mechanically and electrically connect blades 58 and 60 to PCB 54. Each contact blade 58 and 60 includes a substantially square vertically-oriented flat portion 108 adjacent the fixed end 104 and a curved portion 110 at the free end thereof. The curved portion 110 of each contact blade has a radius of curvature of about 0.25 inch and extends substantially longitudinally from its respective flat portion 104, so that each blade 58, 60 is generallY flat, in contrast to the preferred dogleg shape of spring 56. This difference stems from the fact that spring 56 has to provide much more "give" than blade contacts 58 and 60. Each curved portion 110 extends laterally from the corresponding flat portion 108. Also extending laterally from each flat portion 108, on the opposite end from curved portion 110, and perpendicular thereto, is a blade anti-collapse extension 112 which rides upon substrate 55 and prevents the blade contact from collapsing inwardly when the blade is pushed laterally during assembly of PCB 54 into POS 10. Thus, extension 112 forms a right angle with flat portion 108, and the respective extensions 112 of blade contacts 58 and 60 face inward, toward one another. Also, the concave surfaces of curved portions 110 face toward one another, and the convex surfaces (which actually make contact with the power strips) face laterally outward.

FIG. 6 shows a circuit breaker-to-power strip jumper 120 which can be used in lieu of coil 52. As well known to those skilled in the art of multi-outlet strips coil 52 acts to filter noise from incoming A.C. power. Some consumers do not need this degree of power conditioning and would prefer a lower priced POS. Thus, coil 52 can be eliminated and replaced with jumper 120 which includes a long flat portion 122 terminated by a perpendicular power strip lug 124 on one end and a perpendicular circuit breaker lug 126 on the opposite end, wherein lugs 124, 126 are both directed vertically. Like jumper 50, jumper 120 can simply be pushed in place with one motion in contrast to prior art designs which typically used a flexible wire terminated at either end with a slip-on connector of some type.

Figure 7:
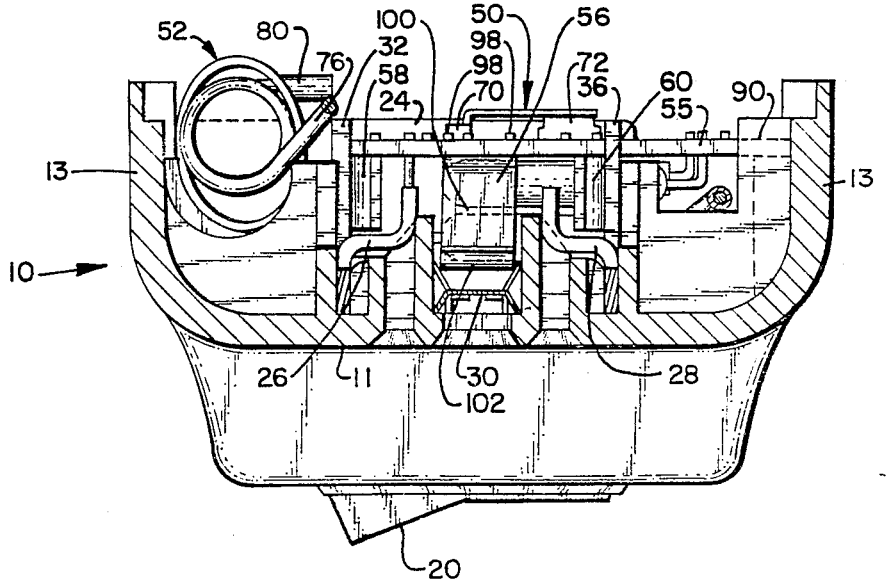
FIG. 7 is an end elevational view of the PCB assembled into the POS, showing the PCB contacts in operation.

FIG. 7 shows an end view of PCB 4 in position showing it in operative contact with power strips 26, 28 and 30.

It should be noted that PCB 54 can include a standard surge suppressing circuit, or any other type of filtering or power conditioning circuit made up of components or devices mounted on substrate 55. As well known to those skilled in the art, POS 10 can be configured such that one terminal of switch 20 is connected to the "hot" wire of cord 16; and the other terminal of switch 20 is connected to circuit breaker 24 via jumper 50. Circuit breaker 24 is in turn connected to "hot" strip 26, either through coil 52 or jumper 120. PCB 54 is preferably connected across all three strips 26, 28, 30 through the operation of resilient contacts 58, 60, 56 extending from substrate 55.

Preferably, as shown in FIGS. 2, 3 and 4, the surge suppressing circuit of PCB 54 includes a pair of metal oxide varistors (MOVs) 130 and 132. MOV 130 is connected between the hot and neutral lines, whereas MOV 132 extends between the hot and ground lines. As well known to those skilled in the art, MOVs 130 and 132 clamp high voltage surges across the hot and neutral wires to safer, lower voltage levels.

There are other modifications which will be apparent to those skilled in the art. Accordingly, the scope of this invention will be limited only by the appended claims.

I claim:

1. A power outlet device comprising:

(a) a strip assembly comprising:
  (i) an elongate conductive ground strip;
  (ii) an elongate conductive neutral strip; and
  (iii) an elongate conductive hot strip;

(b) a printed circuit board assembly comprising a power conditioning circuit;;

(c) a case receiving the strip and printed circuit board assemblies, the case comprising top and bottom surfaces which are substantially parallel to one another; and (d) conductive resilient contact means connected to and extending from the printed circuit board assembly and operatively connecting the printed circuit board assembly to the strip assembly, wherein the assemblies are conductively interconnected simply by positioning the printed circuit board assembly relative to the strip assembly such that the contact means springingly engages the strip assembly, wherein:
  (i) the ground strip forms a ground contact area substantially parallel to the top and bottom case surfaces;
  (ii) the neutral and hot strips form neutral and hot contact areas substantially perpendicular to the top and bottom case surfaces;
  (iii) the conductive resilient contact means comprises a dogleg-shaped ground contact spring engaging the ground contact area;
  (iv) the contact means further comprises neutral and hot resilient conductive blades springingly engaging the neutral and hot contact areas, respectively;
  (v) the printed circuit board assembly comprises a substrate substantially parallel to the top and bottom case surfaces and the ground contact spring comprises a first portion adjacent the substrate, and a second portion angling therefrom, wherein the free end of the second portion contacts the ground contact area; and
  (vi) the neutral and hot contact blades each comprise a flat portion fixed to the substrate and perpendicular thereto, and a curved portion having a convex side and a concave side, wherein the concave sides of the blades face in opposite directions, and the convex sides of the blades engage the neutral and hot contact areas.

2. A power outlet device comprising:

(a) a strip assembly comprising:
  (i) an elongate conductive ground strip;
  (ii) an elongate conductive neutral strip; and
  (iii) an elongate conductive hot strip;

(b) a printed circuit board assembly comprising a substrate and a surge control circuit;

(c) a case receiving the strip and printed circuit board assemblies, wherein the case comprises a bottom cover, and wherein the strips of the strip assembly are arranged within the case parallel to one another;

(d) a resilient dogleg-shaped conductive ground contact spring extending from the substrate of the printed circuit board assembly conductively engaging a ground strip contact area which is substantially parallel to the bottom cover of the case; and (e) neutral and hot contact blades connected to the substrate and to the surge control circuit engaging the neutral and hot strips, respectively, wherein the cover of the case urges against one side of the substrate to press the contacts into resilient conductive contact with the strips of the strip assembly.

3. A power outlet device comprising:

(a) a strip assembly comprising:
(i) an elongate conductive ground strip;
(ii) an elongate conductive neutral strip; and
(iii) an elongate conductive hot strip;
(b) a printed circuit board assembly comprising a power conditioning circuit;
(c) conductive resilient contact means connected to and extending from the printed circuit board assembly and operatively connecting the printed circuit board assembly to the strip assembly:
(d) a coil connected to the hot strip:
(e) an on/off switch for connection to a suitable power supply;
(f) a circuit breaker connected to the coil; and
(g) a one-piece circuit breaker-to-switch jumper conductively connecting the switch to the circuit breaker, wherein the circuit breaker-to-switch jumper can be simultaneously connected to the switch and circuit breaker with one straight motion and wherein the strip and printed circuit board assemblies are conductively interconnected simply by positioning the printed circuit board assembly relative to the strip assembly such that the conductive resilient contact means springingly engages the strip assembly.

4. The power outlet device of claim 3, wherein the switch and circuit breaker comprise terminals, and the circuit breaker-to-switch jumper is L-shaped and planar but for a pair of lugs which engage the terminals on the switch and circuit breaker, the lugs being perpendicular to the L-shaped planar portion of the circuit breaker-to-switch jumper.

5. A power outlet device comprising:
(a) a strip assembly comprising:
(i) an elongate conductive ground strip;
(ii) an elongate conductive neutral strip; and
(iii) an elongate conductive hot strip;
(b) a printed circuit board assembly comprising a substrate and a surge control circuit;
(c) a case receiving the strip and printed circuit board assemblies, wherein the case comprises a bottom cover, and wherein the strips are arranged within the case parallel to one another;
(d) a resilient dogleg-shaped conductive ground contact spring extending from the substrate of the printed circuit board assembly and connected to the surge control circuit, the spring conductively engaging a ground strip contact area which is substantially parallel to the bottom cover of the case;
(e) neutral and hot contact blades connected to the substrate and to the surge control circuit and springingly engaging the neutral and hot strips, respectively, wherein the cover of the case urges against one side of the substrate to press the conductive spring and blades into conductive contact with the respective strips of the strip assembly;
(f) an on/off switch suitable for connection to a power supply;
(g) a circuit breaker;
(h) a circuit breaker-to-switch jumper interconnecting the circuit breaker and the switch and having a planar L-shaped portion and a a pair of lugs extending perpendicularly therefrom; and
(i) a circuit breaker-to-strip jumper interconnecting the circuit breaker and the hot strip and having an elongate portion and a pair of lugs extending perpendicularly therefrom, wherein the jumpers can each be connected in one pushing motion.

6. A power outlet device comprising:
(a) a strip assembly comprising:
(i) an elongate conductive ground strip;
(ii) an elongate conductive neutral strip; and
(iii) an elongate conductive hot strip, each strip comprising a strip terminal;
(b) a printed circuit board assembly comprising a power conditioning circuit;
(c) conductive resilient contact means connected to and extending from the printed circuit board assembly and operatively connecting the printed circuit board assembly to the strip assembly;
(d) an on/off switch for connection to a suitable power supply, the switch comprising a switch terminal;
(e) a circuit breaker comprising first and second circuit breaker terminal;
(f) a circuit breaker-to-strip jumper interconnecting the circuit breaker and the hot strip, wherein the circuit breaker-to-strip jumper comprises an elongate substantially flat portion terminated by a first pair of lugs extending substantially perpendicular thereto and engaging the first circuit breaker terminal and the hot strip terminal; and
(g) a one-piece circuit breaker-to-switch jumper conductively connecting the switch to the circuit breaker, wherein the circuit breaker-to-switch jumper comprises a substantially flat portion terminated by a second pair of lugs extending substantially perpendicular thereto and engaging the second circuit breaker terminal and the switch terminal, wherein each jumper can be simultaneously connected to the corresponding terminals with one straight motion, and wherein the strip and printed circuit board assemblies are conductively interconnected simply by positioning the printed circuit board assembly relative to the strip assembly such that the conductive resilient contact means springingly engages the strip assembly.

* * * * *